US005435328A

United States Patent [19]

Grohoske

[11] Patent Number: 5,435,328

[45] Date of Patent: Jul. 25, 1995

[54] TOILETRY ARTICLE

[76] Inventor: Joan L. Grohoske, 1723 Fostoria Ave., Apt C, Findlay, Ohio 45840

[21] Appl. No.: 114,931

[22] Filed: Sep. 2, 1993

[51] Int. Cl.[6] ..... A45D 24/16

[52] U.S. Cl. ..... 132/120; 132/152; 15/104.002; 15/171; 15/176.1; 15/176.6

[58] Field of Search ..... 132/120, 150, 152, 286, 132/289, 320; 15/104.002, 167.1, 171, 176.1, 176.6, 194, 202, 229.14, 244.1, 244.2, 244.3, 230.17

[56] References Cited

U.S. PATENT DOCUMENTS

| | | | |
|---|---|---|---|
| 1,031,485 | 7/1912 | Stroup | 132/120 |
| 1,497,079 | 6/1924 | Gullborg et al. | 15/244.2 |
| 1,529,372 | 3/1925 | Plater | 132/120 |
| 1,836,833 | 12/1931 | Ames | 132/320 |
| 2,719,315 | 10/1955 | Sheehan | 15/176.6 |
| 3,040,342 | 6/1962 | Vian | 15/104.002 |
| 3,590,414 | 7/1971 | Gores | 15/244.1 |
| 4,299,005 | 11/1981 | Brown | 15/244.2 |
| 4,399,582 | 8/1983 | Ernest et al. | 15/145 |
| 4,638,521 | 1/1987 | Potente et al. | 15/167.1 |
| 4,658,461 | 4/1987 | Roe et al. | 15/176.1 |
| 5,003,659 | 4/1991 | Paepke | 15/244.1 |

FOREIGN PATENT DOCUMENTS

| | | | |
|---|---|---|---|
| 3428115 | 9/1985 | Germany | 132/320 |

*Primary Examiner*—John G. Weiss

[57] ABSTRACT

A multi-purpose toiletry article which comprises: a long, rigid, plastic handle; a preferably oval rigid, plastic support head mounted in fixed or pivotal relationship at one end of such handle; and a removable fastener to removably and interchangeably affix one of a multiple of oval working members to said oval support head.

2 Claims, 4 Drawing Sheets

TOILETRY ARTICLE

BACKGROUND OF THE INVENTION

1. Field of the Invention

The present invention relates to toiletry articles and more particularly pertains to such articles which may be used for multiple purposes.

2. Description of the Prior Art

The use of handle operated toiletry articles is known in the prior art. More specifically, such articles heretofore devised have been utilized for single purposes and are known to consist basically of familiar, expected and obvious structural configurations, notwithstanding the myriad of designs encompassed by the crowded prior art which have been developed for the fulfillment of countless objectives and requirements.

In this respect, the toiletry article according to the present invention substantially departs from the conventional concepts and designs of the prior art, and in so doing provides an apparatus primarily developed for multiple purposes such as applying powders, lotions, or brushing.

Therefore, it can be appreciated that there exists a continuing need for new and improved toiletry articles which can be easily converted for more than one use. In this regard, the present invention substantially fulfills this need.

SUMMARY OF THE INVENTION

In view of the foregoing disadvantages inherent in the known types of toiletry articles now present in the prior art, the present invention provides an improved construction wherein the same can be utilized for a variety of purpose. As such, the general purpose of the present invention, which will be described subsequently in greater detail, is to provide a new and improved toiletry article which has all the advantages of the prior art articles and none of the disadvantages.

To attain this, the present invention essentially relates to a multi-purpose toiletry article which comprises: a long, rigid, plastic handle; a preferably oval rigid, plastic support head mounted in fixed or pivotal relationship at one end of such handle; and means to removably and interchangeably affix one of a multiple of oval working members to said oval support head.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toiletry article which has all the advantages of the prior art articles and none of the disadvantages.

It is another object of the present invention to provide a new and improved toiletry articles which may be easily and efficiently manufactured and marketed.

It is a further object of the present invention to provide a new and improved toiletry article which is of a durable and reliable construction.

An even further object of the present invention is to provide a new and improved toiletry article which is susceptible of a low cost of manufacture with regard to both materials and labor, and which accordingly is then susceptible of low prices of sale to the consuming public, thereby making such articles economically available to the buying public.

Still yet another object of the present invention is to provide a new and improved toiletry article which provides in the apparatuses and methods of the prior art some of the advantages thereof, while simultaneously overcoming some of the disadvantages normally associated therewith.

Still another object of the present invention is to provide a new and improved multi-use toiletry article.

Yet another object of the present invention is to provide a new and improved toiletry article having easily interchangeable working heads.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
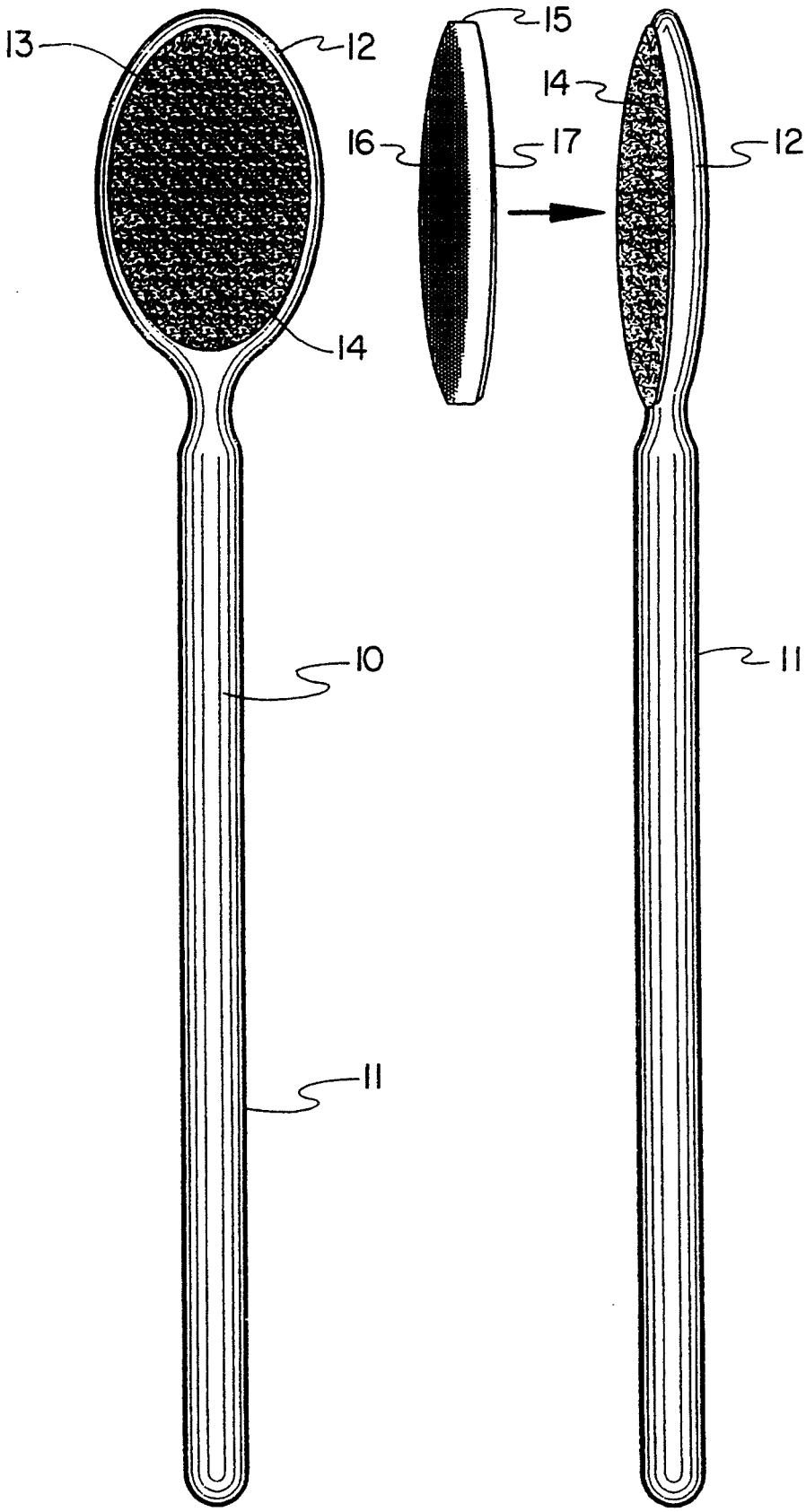
FIG. 1 is front plan elevation of the device of the present invention.
FIG. 2 is a side elevation of the device of FIG. 1 also including one of the replaceable working units.

With reference now to the drawings, and in particular to FIG. 1 thereof, a new and improved toiletry article embodying the principles and concepts of the present invention and generally designated by the reference numeral 10 will be described.

The article 10 comprises, in its simplest form, a long, straight, rigid handle member 11, preferably formed of plastic. At one end of handle member 11, either formed integrally therewith or affixed thereto, is an oval backing or support head 12 having on one face 13 thereof one-half of a hook-loop type fastening means 14. Complementing the support head 12 (as shown in FIG. 2) is an oval, rigid member 15 having on one face 16 a working surface as described hereinafter, and on the back 17 thereof the complementary or mating half of the hook-loop fastener secured to the support head 12. Member 15 will removably fit over the face 13 of head 12 and be secured thereto by the hook-loop fasteners.

Figure 3:
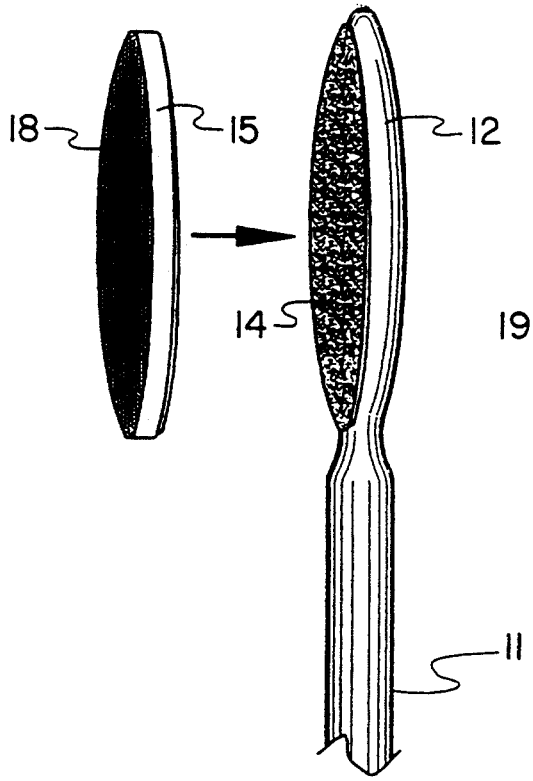
FIGS. 3, 4, 5, and 6 are partial side views each showing one of the replaceable working units.
Figure 4:
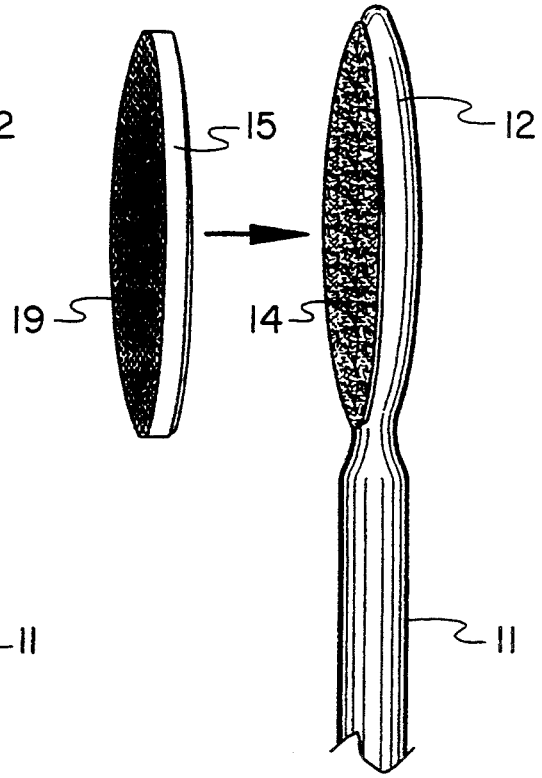
Figure 5:
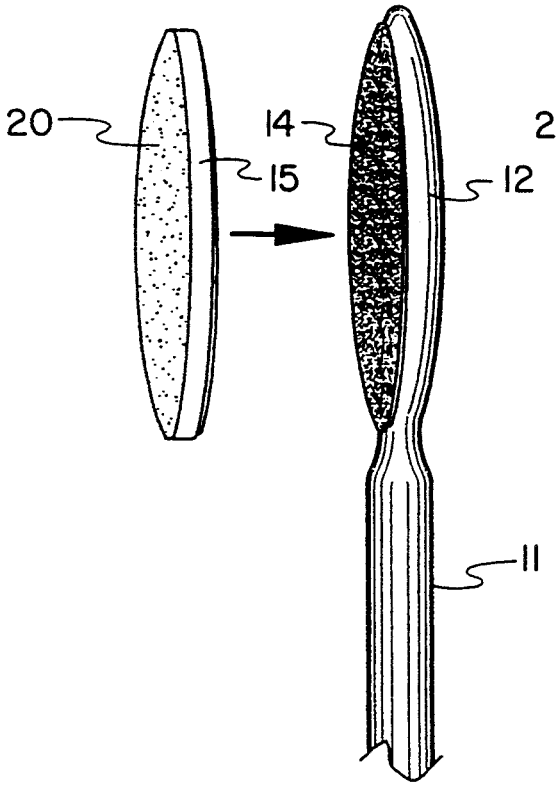
Figure 6:
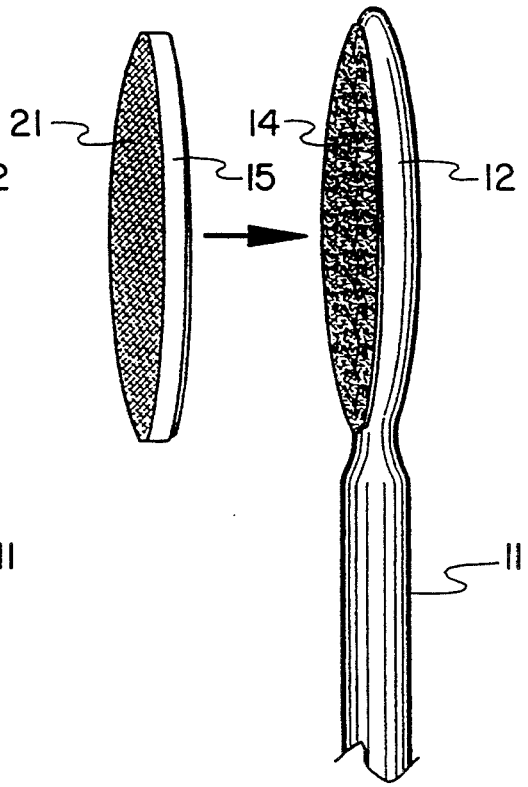

As shown in FIGS. 3 through 6, the working surface 16 may vary and a variety of such oval, rigid members 15 carrying a different working surfaces 16 are supplied for use with the basic handle 11 and support head 12. FIG. 3 shows a member 15 with a sponge surface 18 thereon; FIG. 4 with an adhesive lint remover 19 thereon; FIG. 5 with a powder puff 20 thereon; and FIG. 6 with a brush 21 thereon.

Figure 7:
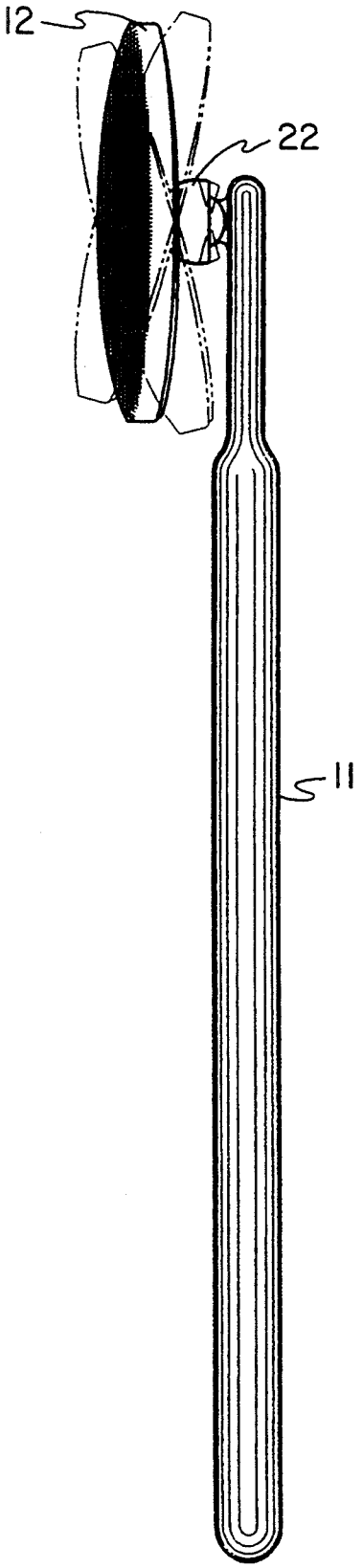
FIG. 7 is a side view of a modification of the device in FIG. 1.
Figure 8:
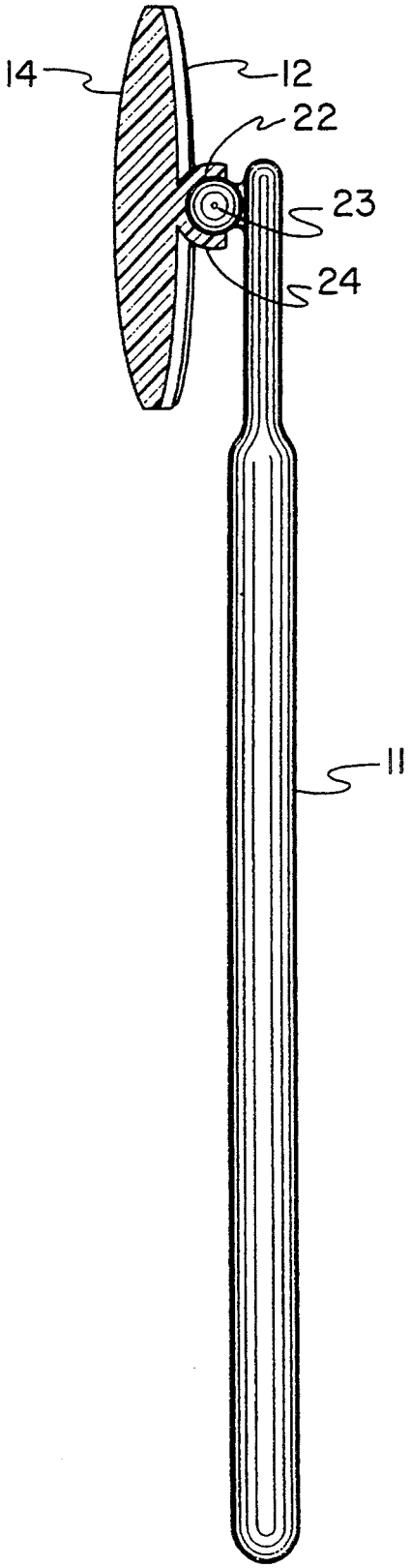
FIG. 8 is a sectional view of the device of FIG. 7.

Further modifications within the scope of the invention may be made in the basic handle-support head configuration. For example, FIGS. 7 and 8 illustrate the provision of head 12 with a simple pivoting mechanism 22 on the back thereof connecting head 12 to handle 11. As more clearly shown in FIG. 8, the pivoting mechanism 22 comprises a pin 23 affixed to handle 11 and a clip 24 affixed to the back of support head 12 and adapted to elastically engage with pin 23 permitting head 12 to pivot up or down as shown in the broken lines of FIG. 7.

Figure 9:
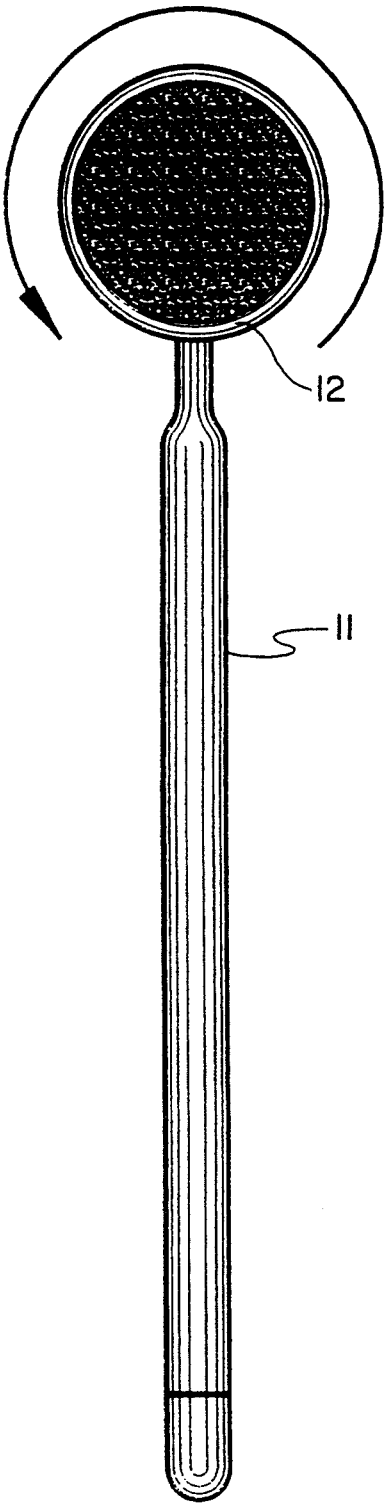
FIG. 9 is a front elevation of a further modification of the invention.
Figure 10:
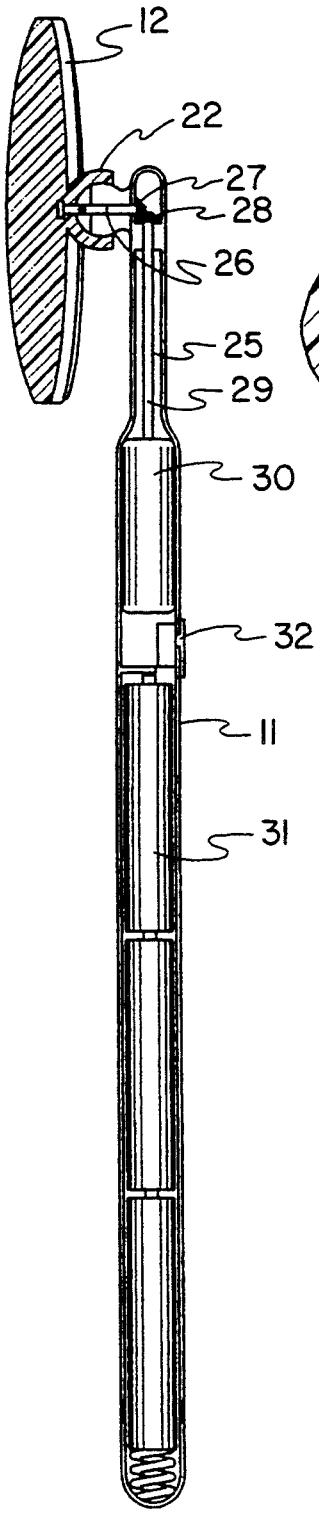
FIG. 10 is a sectional view of the device of FIG. 9.
Figure 11:
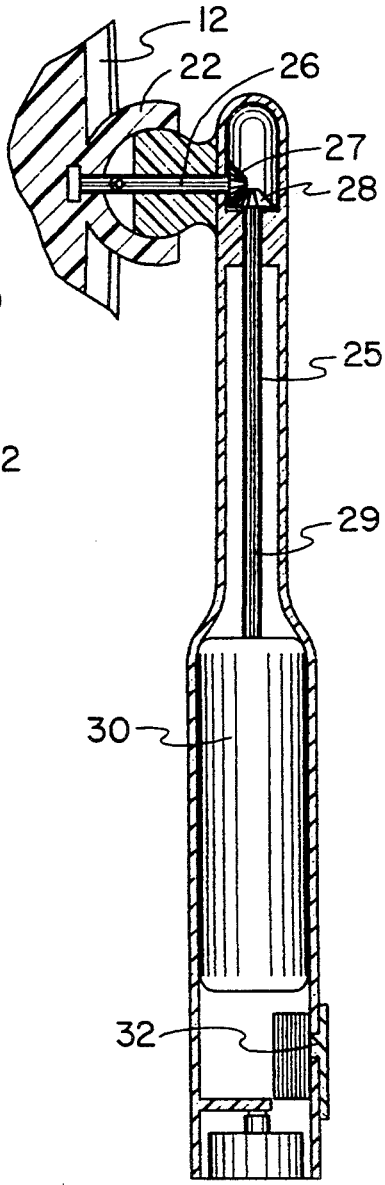
FIG. 11 is an enlarged sectional view of such device.

FIGS. 9 through 11 show a more sophisticated version of the invention wherein the head 12 is both pivotal as in FIGS. 7 and 8 and also is capable of being rotated by a power driven mechanism 25. This version uses the same pivoting mechanism 22 as in FIGS. 7 and 8 but also has a drive shaft 26 affixed to the back of head 12 and connected by gears 27 and 28 to the drive shaft 29 of a battery operated motor 30. The handle 11 in this case is hollow and of sufficient diameter to hold A—A batteries 31 therein to power motor 30. An on-off switch 32 is provided along with conventional wiring to operate motor 30. In the interest of safety, the head 12 in this modification is circular rather than oval and the working surface replaceable members adapted to be secured thereto will correspondingly be circular in configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toiletry article comprising:

an elongated, rigid handle member having a first end and a second end, with a pin projecting from said first end thereof;

an oval support head having a clip integrally formed therein, said clip projecting from said support head and engaging said pin to pivotally mount said support head to said first end of said handle member;

one-half of a hook and loop type fastening fabric secured to a face of said support head;

and an oval rigid member conforming in shape to said support head, said rigid member having on one face thereof another-half of said hook and loop type fastening fabric, and on an opposite face a working surface comprising a lint remover.

2. A toiletry article comprising:

an elongated, rigid handle member having a first end and a second end, with a pin projecting from said first end thereof;

an oval support head having a clip integrally formed therein, said clip projecting from said support head and engaging said pin to pivotally mount said support head to said first end of said handle member;

one-half of a hook and loop type fastening fabric secured to a face of said support head;

and an oval rigid member conforming in shape to said support head, said rigid member having on one face thereof another-half of said hook and loop type fastening fabric, and on an opposite face a working surface comprising a brush.

* * * * *